US009369787B2

(12) United States Patent
Tossavainen et al.

(10) Patent No.: US 9,369,787 B2
(45) Date of Patent: Jun. 14, 2016

(54) SHIELDED AUDIO APPARATUS

(71) Applicant: Nokia Corporation, Espoo (FI)

(72) Inventors: Antero Johannes Tossavainen, Espoo (FI); Veijo Kajanus, San Diego, CA (US); Jian Guo, San Diego, CA (US)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 13/908,341

(22) Filed: Jun. 3, 2013

(65) Prior Publication Data

US 2014/0355812 A1 Dec. 4, 2014

(51) Int. Cl.

| | |
|---|---|
| ***H04R 1/02*** | (2006.01) |
| ***H04R 1/06*** | (2006.01) |
| ***H04R 3/00*** | (2006.01) |
| *H04R 1/04* | (2006.01) |

(52) U.S. Cl.

CPC ..... *H04R 1/02* (2013.01); *H04R 1/023* (2013.01); *H04R 1/06* (2013.01); *H04R 3/007* (2013.01); *H04R 1/04* (2013.01); *H04R 2209/022* (2013.01)

(58) Field of Classification Search

CPC ..... H04R 1/02; H04R 1/023; H04R 1/028; H04R 1/04; H04R 1/086; H04R 2209/022; H04R 1/06; H04R 3/007

USPC ..... 381/189, 395, 386, 322, 324, 355, 359, 381/361, 369, 394; 181/148, 149

See application file for complete search history.

(56) References Cited

U.S. PATENT DOCUMENTS

| | | | | |
|---|---|---|---|---|
| 7,940,950 | B2 * | 5/2011 | Shim | 381/393 |
| 8,041,048 | B2 * | 10/2011 | Shim | 381/71.1 |
| 2003/0128847 | A1 * | 7/2003 | Smith | 381/67 |
| 2004/0228494 | A1 * | 11/2004 | Smith | 381/67 |
| 2005/0207610 | A1 * | 9/2005 | Kajiwara et al. | 381/396 |
| 2006/0035663 | A1 * | 2/2006 | Cheng | 455/550.1 |
| 2006/0177085 | A1 * | 8/2006 | Izuchi et al. | 381/369 |
| 2008/0219464 | A1 * | 9/2008 | Smith | 381/67 |
| 2010/0177922 | A1 * | 7/2010 | Park et al. | 381/355 |
| 2013/0328648 | A1 * | 12/2013 | Kuivallainen et al. | 335/219 |
| 2014/0056448 | A1 * | 2/2014 | Kuivalainen et al. | 381/189 |

FOREIGN PATENT DOCUMENTS

| | | | | |
|---|---|---|---|---|
| WO | WO2012063105 | * | 5/2012 | H04R 1/02 |

* cited by examiner

*Primary Examiner* — Curtis Kuntz
*Assistant Examiner* — Joshua A Kaufman
(74) *Attorney, Agent, or Firm* — Harrington & Smith

(57) ABSTRACT

An apparatus including a transducer membrane for generating sound waves; and a plate, through which sound waves can pass, at least partially overlaying the transducer membrane configured to produce a magnetically shielded region so to impede particles reaching the transducer membrane.

19 Claims, 9 Drawing Sheets

SHIELDED AUDIO APPARATUS

FIELD OF THE APPLICATION

The present application relates to a method and apparatus for magnetic and electrostatic discharge shielding. In some embodiments the method and apparatus relate to a magnetic and electrostatic discharge shielding for transducers.

BACKGROUND OF THE APPLICATION

Some portable electronic devices comprise transducers such as loudspeakers and/or earpieces which are required to be small in size. Transducers are important components in electronic devices such as mobile phones for the purposes of playing back music or having a telephone conversation. The quality and loudness of a transducer in an electronic device are important especially if a user listens to sounds generated by an electronic device at a distance from the electronic device.

Furthermore in portable devices dust and water protection is important specifically with regards to the transducers. However dust and other small particles (and water) can often reach the transducer components and cause component damage. In particular the dynamic moving coil components in transducers radiate in each direction as the diaphragm moves forwards and backwards and as the construction of the transducer typically has open outlets on either side of the transducer which are free to air and the permanent magnet of a moving coil transducer can attract magnetic particles which migrate through the portable device and reach the coil and diaphragm. These particles can damage the sensitive components and/or reduce the performance of these components when the apparatus is in operation.

For example after some time the force between magnetic dust on the diaphragm and the permanent magnet inside the electrodynamic loudspeaker can pull the diaphragm towards the magnet and make the sound quieter, cause distortion or both. These types of failure typically requires repair and are costly to the manufacturer of the device if the failure occurs within the warranty period. Furthermore these features can cause brand damage if the failure occurs soon after the warranty period as the user considers the device to have failed prematurely and of poor quality.

SUMMARY OF SOME EMBODIMENTS

In a first aspect of the application there is provided an apparatus comprising a transducer membrane for generating sound waves: and a plate, through which sound waves can pass, at least partially overlaying the transducer membrane configured to produce a magnetically shielded region to impede particles reaching the transducer membrane.

The plate may be located between the transducer membrane and an apparatus cover with at least one conduit configured to permit sound waves to pass through the at least one plate.

The apparatus may further comprise a dust net located proximate to the at least one conduit configured to permit sound waves to pass through the dust net.

The apparatus may further comprise a cover comprising at least one cover conduit configured to permit sound waves to pass through the cover.

The at least one cover conduit and the plate conduit may be skewed with respect to the relative direction to the transducer membrane.

The plate conduit edges may be coated by a material whose relative permeability is lower than the plate.

The plate may comprise at least one of: a mu-metal plate; a material with high magnetic permeability; stainless steel grade SUS 310; stainless steel grade SUS 430; a permalloy plate; a high magnetic permeability metal alloy plate; a nanocrystaline grain structure ferromagnetic metal coating; a shielding foil; an ultra-low carbon steel plate; an amumetal plate; an amunickel plate; a cryoperm plate; and a ferrite (RFIC40 or GAR11030) plate.

The apparatus may further comprise: at least one transducer contact configured to supply a transducer comprising the transducer membrane with a signal; and at least one grounding contact wherein the plate is conductive and is further coupled to the at least one grounding contact such that an electrostatic discharge passes from the plate through the grounding contact and away from the transducer.

The apparatus may further comprise at least two transducer contacts configured to supply a transducer comprising the transducer membrane with a signal.

The apparatus may further comprise: a support configured to support the transducer comprising the transducer membrane, wherein the transducer is electrically coupled to the support by at least one coupling coupled to the at least one transducer contact and by at least one ground coupling coupled to the transducer at least one grounding contact such that the electrostatic discharge passes from the plate through the grounding contact and away from the transducer by the at least one ground coupling; and at least one audio driver further sported by the support and configured to be coupled via the at least one coupling to the at least one transducer contact.

The at least one transducer contact and the at least one grounding contact may be a contact spring.

According to a second aspect there is provided a method comprising: providing a transducer membrane for generating sound waves; and locating a plate, through which sound waves can pass, at least partially overlaying the transducer membrane configured to produce a magnetically shielded region to impede particles reaching the transducer membrane.

Providing the plate may comprise locating the plate between the transducer membrane and an apparatus cover with at least one conduit configured to permit sound waves to pass through the plate.

The method may further comprise locating a dust net proximate to the at least one conduit wherein the dust net is configured to permit sound waves to pass through the dust net.

The method may further comprise providing a cover, wherein providing the cover comprises providing at least one cover conduit configured to permit sound waves to pass through the cover.

The method may further comprise skewing the at least one cover conduit and the plate conduit with respect to the relative direction to the transducer membrane.

The method may comprise coating at least one edge of the plate conduit with a material whose relative permeability is lower than the plate.

The plate may comprise at least one of: a mu-metal plate; a material with high magnetic permeability; stainless steel grade SUS 310; stainless steel grade SUS 430; a permalloy plate; a high magnetic permeability metal alloy plate; a nanocrystaline grain structure ferromagnetic metal coating; a shielding foil; an ultra-low carbon steel plate; an amumetal plate; an amunickel plate; a cryoperm plate; and a ferrite (RFIC40 or GAR11030) plate.

The method may further comprise: providing at least one transducer contact configured to supply a transducer comprising the transducer membrane with a signal; and providing at least one grounding contact wherein the plate is conductive and is further coupled to the at least one grounding contact such that an electrostatic discharge passes from the plate through the grounding contact and away from the transducer.

Providing at least one transducer contact configured to supply a transducer comprising the transducer membrane with a signal may further comprise providing at least two transducer contacts configured to supply a transducer comprising the transducer membrane with a signal.

The method may further comprise: providing a support configured to support the transducer comprising the transducer membrane; electrically coupling the transducer to the support by at least one coupling coupled to the at least one transducer contacts and by at least one ground coupling coupled to the transducer at least one grounding contact such that the electrostatic discharge passes from the plate through the grounding contact and away from the transducer by the at least one ground coupling; providing at least one audio driver further supported by the support; and electrically coupling the at least one audio driver via the at least one coupling to the at least one transducer contact.

The method may further comprise coupling by a contact spring at least one of: the at least one transducer contact; and the at least one grounding contact.

According to a third aspect there is provided an apparatus comprising: sound wave generating means: and plate means, through which sound waves can pass, at least partially overlaying the sound wave generating means, wherein the plate means are configured to produce a magnetically shielded region to impede particles reaching the sound wave generating means.

The plate means may be located between the sound wave generating means and the apparatus cover with at least one means to permit sound waves to pass through the plate means.

The apparatus may further comprising dust net means located proximate to the at least one conduit configured to permit sound waves to pass through the dust net means.

The apparatus may further comprising cover means comprising at least one conduit means configured to permit sound waves to pass through the cover means.

The at least one cover conduit means and the at least one means to permit sound waves to pass through the plate means may be skewed with respect to the relative direction to the sound wave generating means.

The plate means proximate to the at least one means to permit sound waves to pass through the plate comprises a coating by a material whose relative permeability is lower than the plate means.

The plate means may comprise at least one of: a mu-metal plate; a material with high magnetic permeability; stainless steel grade SUS 310; stainless steel grade SUS 430; a permalloy plate; a high magnetic permeability metal alloy plate; a nano-crystaline grain structure ferromagnetic metal coating; a shielding foil; an ultra-low carbon steel plate; an amumetal plate; an amunickel plate; a cryoperm plate; and a ferrite (RFIC40 or GAR11030) plate.

The apparatus may further comprise: at least one transducer contact means configured to supply the sound wave generating means with a signal; and at least one grounding contact means wherein the plate means is conductive and is further coupled to the at least one grounding contact means such that an electrostatic discharge passes from the plate means through the at least one grounding contact means and away from the sound generating means.

The apparatus may further comprise: support means for supporting the sound generating means, wherein the sound generating means is configured to be electrically coupled to the support by at least one coupling means coupled to the at least one transducer contact means and by at least one ground coupling means coupled to the sound generating means at least one grounding contact means such that the electrostatic discharge passes from the plate means through the grounding contact means and away from the sound generating means by the at least one ground coupling means; and at least one audio driver means further supported by the support means and configured to be coupled via the at least one coupling means to the at least one transducer contact means.

The at least one transducer contact means and the at least one grounding contact means may be a contact spring.

According to a fourth aspect there is provided an apparatus comprising: at least one display; at least one processor; at least one memory coupled to the at least one processor; and at least one transducer comprising a transducer membrane for generating sound waves; and a plate, through which sound waves can pass, at least partially overlaying the transducer membrane configured to produce a magnetically shielded region to impede particles reaching the transducer membrane.

The plate may be an integral plate.

An electronic device may comprise an apparatus as described above.

Embodiments of the present invention aim to address one or more of the above problems.

BRIEF DESCRIPTION OF DRAWINGS

For a better understanding of the present application and as to how the same may be carried into effect, reference will now be made by way of example to the accompanying drawings in which.

SOME EMBODIMENTS OF THE APPLICATION

The following describes apparatus and methods for magnetically shielding and electrostatically protecting a transducer.

In providing magnetic shielding for speakers or transducers often a protective mesh or other porous material, where appropriate, is implemented to assist audio reproduction quality but maintain good reliability of the transducer by protecting the transducer from particles entering through the sound outlets in the device. For example a dust net can be placed in front of the loudspeaker. However the more effective a dust net is, in other words the denser the material used, the more attenuation to the sound generated by the speaker and therefore the muffling of the speaker output occurs.

In some situations a complicated mechanical channel structure can be used to improve dust protection by making the route longer from the outer surface of the phone to the loudspeaker diaphragm. However longer channel structures require additional volume within the device and furthermore require the height or depth of the phone to be increased in order to employ the additional channel length. These increased dimensions are counter to the current design trend to make the phone as thin as possible in order to create a device which is as portable as possible.

The use of magnetic shields have also been proposed (such as using a perforated μ-metal plate that lets sound pass through). The magnetic shield can be placed in front of the loudspeaker and used to weaken the stray magnetic field and effectively alter the direction of the attractive force.

Figure 2:
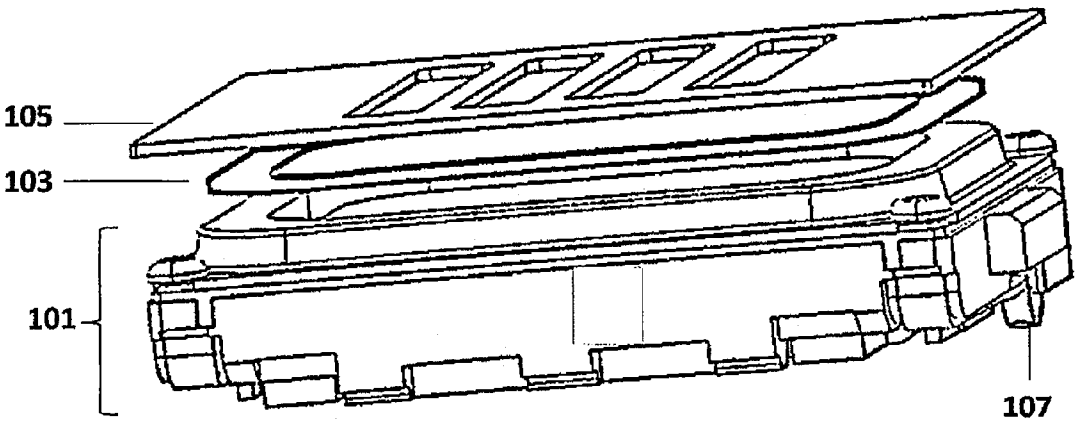
Figure 2 PRIOR ART
FIG. 2 illustrates a schematic diagram of a prior art magnetic shield configuration.

With respect to FIG. 2 an example transducer-shield combination is shown. In this example there is shown a transducer 101 which comprises speaker terminals 107 configured to operate as signal springs. In other words both mechanically support the transducer from the printed wiring board (PWB) or printed circuit board (PCB) or flexible printed circuit (FPC) but to also provide the electrical coupling between the transducer coil and the amplifier (such as an integrated hands free amplifier) such that the transducer can be driven by the amplifier. It would be understood that whilst the embodiments shown here demonstrate the use of signal springs as speaker terminals that in some embodiments any suitable coupling can be implemented, for example soldering such as surface mounted soldering or wire soldering can be employed.

In such an example to minimize the magnetic flux magnitude experienced by the transducer a separate special (magnetic conducting) metal plate 105 is located on top of the transducer 101. The metal plate 105 as shown is configured to have at least one hole or slot through which the acoustic waves generated by the transducer can pass. To bond the metal plate 105 to the transducer the structure typically requires an extra sheet of adhesive or poron 103 between transducer 101 (speaker) and metal plate 105 to provide a suitable acoustic seal. It would be realised that the extra parts in terms of the metal plate and the sheet of adhesive or poron cause extra component and logistics cost and complexity in product design and assembly, and furthermore increase the height of the transducer design.

Figure 9:
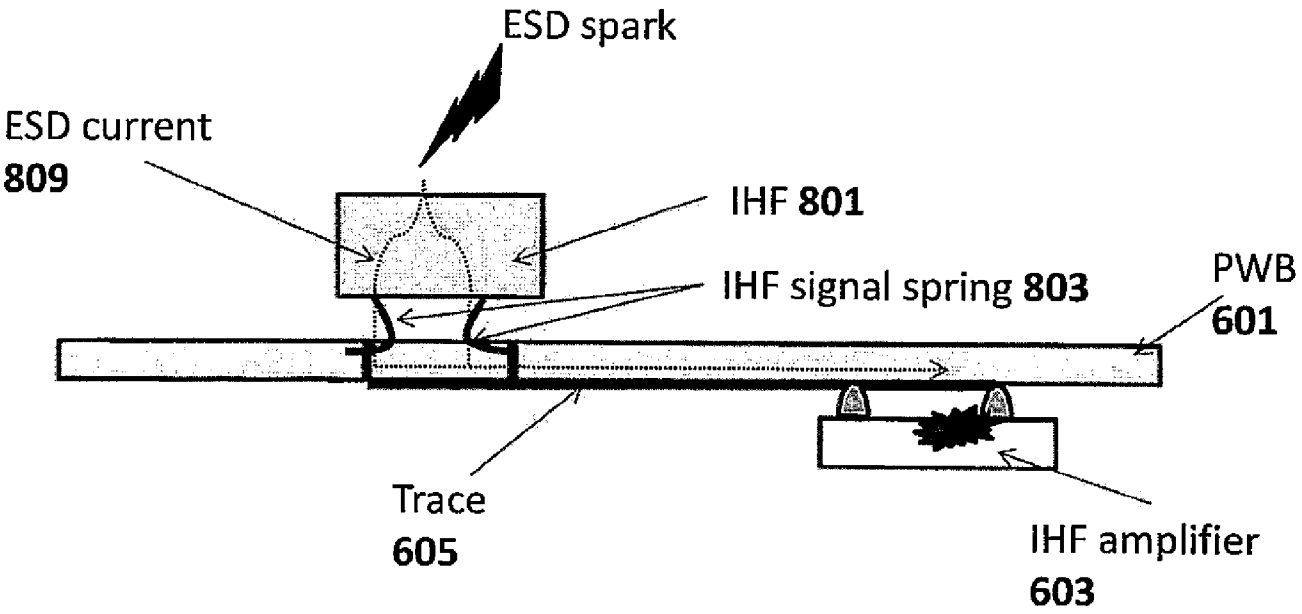

Furthermore as well as dust and foreign material damage to the transducer a further problem in modern transducer design reliability is electrostatic discharge failure. An example of which can be seen in FIG. 9. FIG. 9 shows an example transducer, an integrated hands free (INF) transducer 801, mounted on a PWB 601 via the transducer signal spring 803. Furthermore on the printed wiring board 601 is a trace 605 electrically coupling the transducer (IHF) signal spring 803 to a transducer (IHF) amplifier 603.

In the example shown in FIG. 9 an electrostatic discharge (ESD) spark connecting to the transducer (IHF) 801 can generate an ESD current 809 shown in FIG. 9 as a dotted line which passes through the transducer signal spring 803 and the trace 605 to the transducer (IHF) amplifier 603.

Examples of ESD sparks can be those generated during type approval and product reliability testing. These can easily break modern transducer (IHF or speaker) amplifier when conducting through the sound outlet to speaker. The transducer amplifiers typically are not designed to handle ESD currents generated by ESD sparks and very vulnerable to ESD shock due to limitations in silicon area, cost, and increased digital signal processing (DSP) requirements on chip (such as audio DSP algorithms, speaker protection).

It has been proposed to fix the problem by adding passive components (such as ferrites, varistors) within the speaker lines (trace 605) to protect the amplifier. These passive components are costly and they require space on the PWB (PWB footprint) or flexible printed circuits "flex" (FPC), and require extra logistical effort, slow down production and add complexity. Furthermore the audio performance of such systems is lower than a simple circuit with less losses and resistance.

The addition of a floating metal plate above the transducer, such as shown in the magnetically shielded example in FIG. 2 will generally not improve the ESD resistance of the system. An example ESD situation is shown in FIG. 8.

Figure 8:
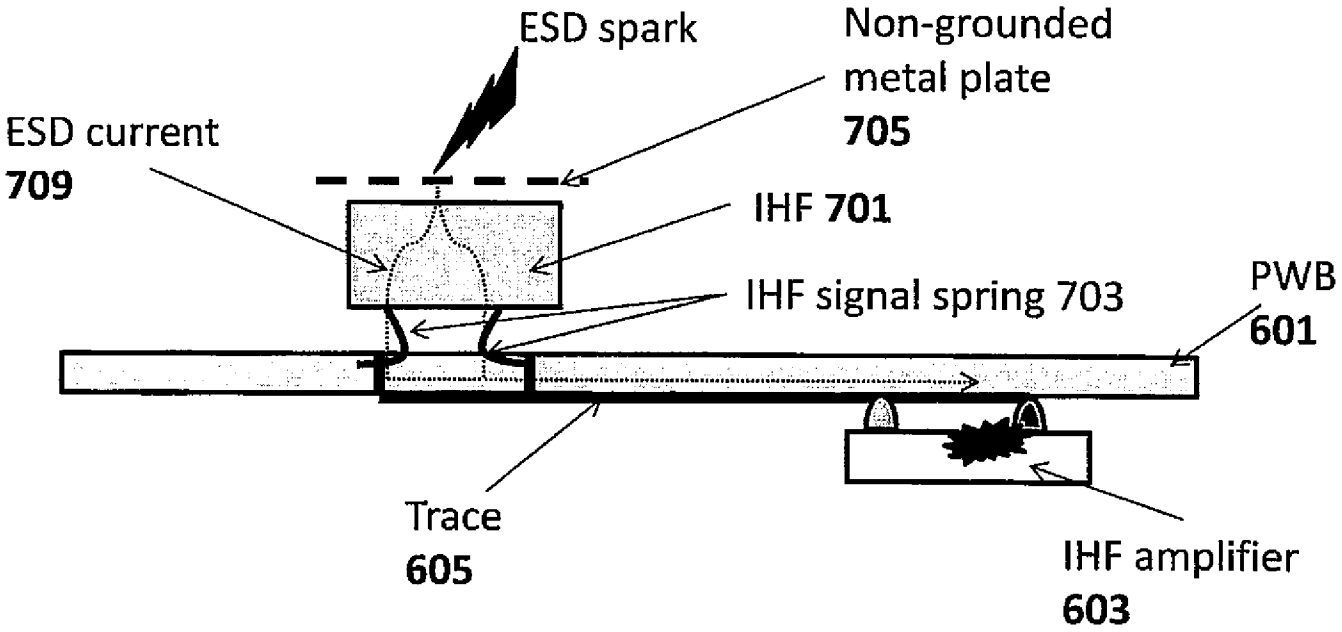
FIGS. 8 and 9 illustrate electrostatic damage which can occur in current transducer configurations.

FIG. 8 shows an example transducer, an integrated hands free (IHF) transducer 701, mounted on a PWB 601 via the transducer signal spring 703. The integrated hands free (IHF) transducer 701 can be seen with the non-grounded (or floating) metal plate 705 located above the transducer 701 and configured to provide some magnetic shielding to the transducer. Furthermore on the printed wiring board 601 is a trace 605 electrically coupling the transducer (IHF) signal spring 703 to a transducer (IHF) amplifier 603.

In the example shown in FIG. 8 an electrostatic discharge (ESD) spark connecting to the non-grounded metal plate 705 would generate an ESD current 709 shown in FIG. 8 as a dotted line which passes through transducer (IHF) 701 can the transducer signal spring 703 and the trace 605 to the transducer (IHF) amplifier 603 and producing similar effects to the application of a ESD spark to transducer without a plate.

Another way that has been proposed to protect the speaker from ESD spark is to ground a metal plate in front of the speaker as discussed with respect to FIG. 2 by adding a separate metal plate adds height and design complexity especially where the extra plate needs to be acoustically sealed to component by adhesive or poron layer which adds still further height and design & assembly complexity. It would be appreciated that grounding the extra plate produces a further challenge with respect to design and assembly would not be possible in many circumstances.

The concept with respect to the embodiments described herein is to mechanically and electrically integrate a metal plate to the transducer or speaker on a component level. The result of which is a transducer with integrated magnetic shielding and furthermore integrated ESD protection.

Thus in some embodiments the transducer with integrated metal plate is designed with a 'third' contact leg which is configured to 'ground' the front metal plate on a PWB or flexible printed circuits "flex" (FPC). Grounding the metal plate thus produces a clear path for the ESD to follow and avoid the ESD sensitive components.

The concept is such that embodiments provide a ready solution (fully integrated transducer or speaker component) that includes a grounded metal plate for ESD protection and further magnetically shields the transducer from metallic particles.

In such embodiments by integrating the shield plate on a component level also reduces the total height or Z-thickness of the transducer as no separate adhesive/poron layer is needed between the speaker component and shield plate.

Figure 1:
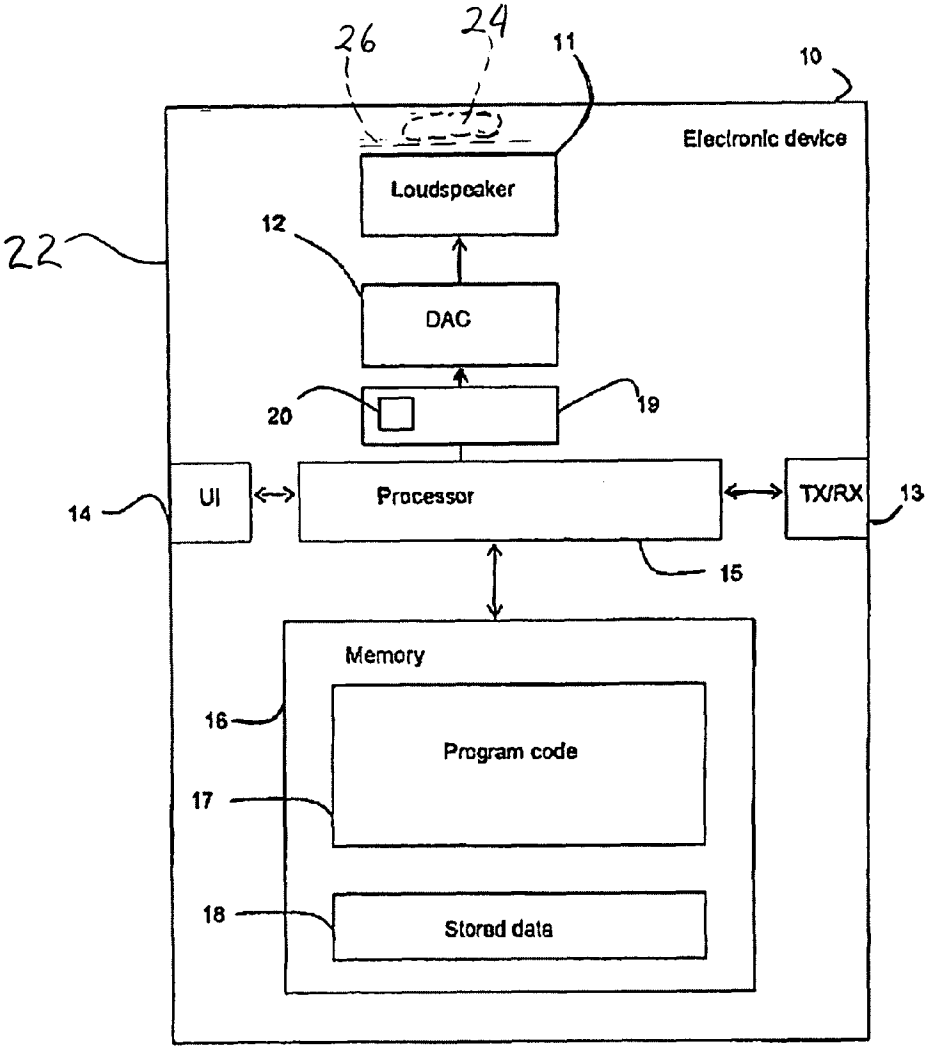
FIG. 1 illustrates a schematic block diagram of an apparatus according to some embodiments.

FIG. 1 shows a schematic representation of an electronic device or apparatus 10 comprising a suitable transducer or speaker 11. The transducer 11 may be an integrated speaker such as an integrated hands free (IHF) speaker (or loudspeaker or earpiece).

The transducer 11 in some embodiments can be any suitable speaker type comprising a permanent magnet. Additionally or alternatively the transducer 33 comprises a multifunction device (MFD) component having any of the following; combined earpiece, integrated handsfree speaker, vibration generation means or a combination thereof.

The apparatus 10 in some embodiments can be a mobile phone, portable audio device, or other means for playing sound. The apparatus 10 includes an apparatus cover 22 and a cover conduit 24 acting as a sound outlet for permitting sound waves to pass from the transducer 11 to the exterior environment. The apparatus 10 also includes a dust net 26 located proximate to the cover conduit 24.

The apparatus 10 is in some embodiments a mobile terminal, mobile phone or user equipment for operation in a wireless communication system.

In other embodiments, the apparatus 10 is any suitable electronic device configured to generate sound, such as for example a digital camera, a portable audio player (mp3 player), a portable video player (mp4 player) and a portable computer, for example a laptop PC. In some other embodiments the apparatus 10 can be any suitable audio or audio subsystem component or any suitable audio capture/audio rendering device In some embodiments, the apparatus 10 comprises a sound generating module 19 which is linked to a processor 15. The processor 15 can be configured to execute various program codes. The implemented program codes may comprise a code for controlling the transducer 11 to generate sound waves. In some embodiments the sound generating module 19 comprises a transducer protection module 20 for modifying the audio signals for the transducer 11.

The implemented program codes in some embodiments 17 can be stored for example in the memory 16 for retrieval by the processor 15 whenever needed. The memory 16 could further provide a section 18 for storing data, for example data that has been processed in accordance with the embodiments. The code can, in some embodiments, be implemented at least partially in hardware or firmware.

In some embodiments the processor 15 is linked via a digital-to-analogue converter (DAC) 12 to the transducer 11. The digital to analogue converter (DAC) 12 can be any suitable converter.

In some embodiments the DAC 12 sends an electronic audio signal output to the transducer 11 and on receiving the audio signal from the DAC 12, the transducer 11 generates acoustic waves. In other embodiments, the apparatus 10 receives control signals for controlling the transducer 11 from another electronic device.

The processor 15 can be further linked to a transceiver (TX/RX) 13, to a user interface (UI) 14 and to a display (not shown). The user interface 14 can enable a user to input commands or data to the apparatus 10. Any suitable input technology can be employed by the apparatus 10. It would be understood for example the apparatus in some embodiments could employ at least one of a keypad, keyboard, mouse, trackball, touch screen, joystick and wireless controller to provide inputs to the apparatus 10.

Although the example transducer shown herein is shown as a speaker (in other words converting electrical or electronic signals into acoustic waves), it would be understood that in some embodiments the transducer is a microphone converting acoustic waves into electrical or electronic signals.

Figure 3:
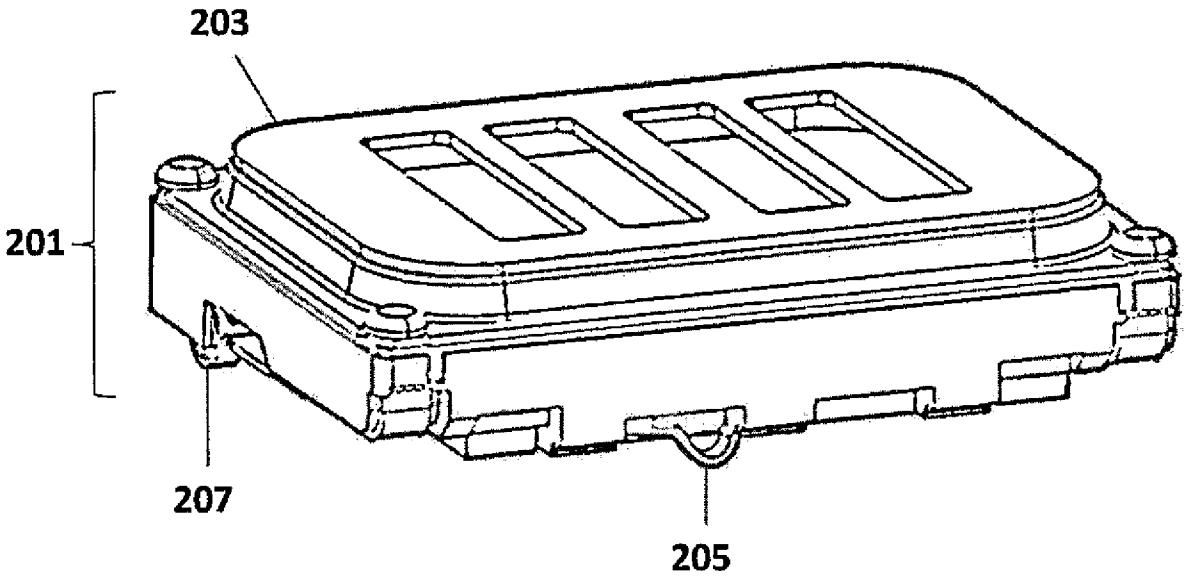
FIG. 3 illustrates a schematic orthogonal projection diagram of an integrated magnetic shield transducer configuration according to some embodiments of the application.

With respect to FIG. 3 an isometric projection view of an example transducer according to some embodiments is shown. The transducer 201 can be seen comprising an integrated metal layer or plate 203 over the transducer. The integrated metal layer or plate 203 can for example form part of the transducer cover or casing. In some embodiments the integrated metal layer or plate can be formed from a μ-metal material. In some embodiments the integral conductive plate comprises at least one of: a material with high magnetic permeability; stainless steel grade SUS 310 plate; and stainless steel grade SUS 430 plate; a perm-alloy plate; a high magnetic permeability metal alloy plate; a nano-crystaline grain structure ferromagnetic metal coating; a shielding foil; an ultra-low carbon steel plate; an amumetal plate; an amu-nickel plate; a cryoperm plate; and a ferrite (RFIC40 or GAR11030) plate. Furthermore in general the material is one aiming to reduce or shielding the magnetic field density of the transducer components. The integrated metal layer or plate can comprise at least one narrow gap which is shaped to contain or collect metal dust by means of concentrating the magnetic field to certain regions on the surface. These concentrated magnetic field regions can be referred to as being the dust trap region.

Furthermore although FIG. 3 shows the transducer or speaker located in an orientation where the integrated metal layer or plate is above the transducer magnet, coil and piston it would be understood that the terms above and below are simply reference directions and do not limit embodiments of the application to any particular alignment or directional orientation.

With respect to FIG. 3 the integrated metal layer or plate 203 is shown with four sound output holes. These four sound outlet holes are rounded rectangular shaped holes, however it would be understood that in some embodiments any suitable number, shape and arrangement of holes can be used to allow acoustic or sound waves to pass through the metal layer or plate 203. Thus in some embodiments the metal layer or plate 203 can comprise outlet holes as a single hole, or at least one slit. In some embodiments the output holes can have integrated acoustic transparent or opaque covers such as wire mesh or wire-net to further reduce foreign bodies entering the transducer. It would be understood that in some embodiments the sound holes can be located or ported on at least one side of the transducer. In the following examples the sound holes are ported on an 'upper' surface or side of the transducer. However it would be understood that the sound hole or sound holes in some embodiments can be ported on any suitable surface or side of the transducer assembly.

With respect to FIG. 3 furthermore is shown the speaker or transducer coil signal springs 207. The speaker or transducer signal springs 207 are configured to at least partially mechanically couple the transducer to a chassis or printed wiring board (PWB) or flexible printed circuits "flex" (FPC). Furthermore in some embodiments the speaker or transducer signal springs are configured to electrically couple the speaker coil to a suitable transducer amplifier. It would be understood that the chassis or printed wiring board (PWB) is an example of a suitable support on which the transducer can be supported. Other suitable support forms can for example be printed circuit boards (PCB), or flexible printed circuits "flex" (FPC). Furthermore as shown in FIG. 3 the speaker or transducer signal springs (and furthermore the grounding spring) are examples of suitable couplings between the transducer and the support. It would be understood that any suitable coupling or connection can be employed in some embodiments such as wires and leafs.

In the example shown in FIG. 3 a single signal spring 207 is shown located along a short side (width) of the transducer however it would be understood that there are at least two signal springs, where at least one is defined as a positive terminal signal spring coupled to one end of the transducer coil and at least one signal spring defined as a negative terminal signal spring coupled to the opposite end of the transducer coil. It would be understood that in some embodiments the signal spring(s) 207 can be located at any suitable position on the underside of the transducer such that the transducer can rest or mechanically be supported by the signal springs when located on the printed wiring board.

Furthermore FIG. 3 shows the transducer comprising at least one grounding spring 205. The at least one grounding spring 205 can in some embodiments be electrically coupled via internal wiring to the metal plate or layer 203. For example in some embodiments the integral metal plate or layer 203 forms integrally the upper half of the transducer casing or support structure which is connected via a suitable electrical pathway to the at least one grounding spring 205. The grounding spring 205 can in such embodiments form a third or further 'leg' further providing mechanical stability for the transducer as it rests on the printed wiring board.

Figure 4:
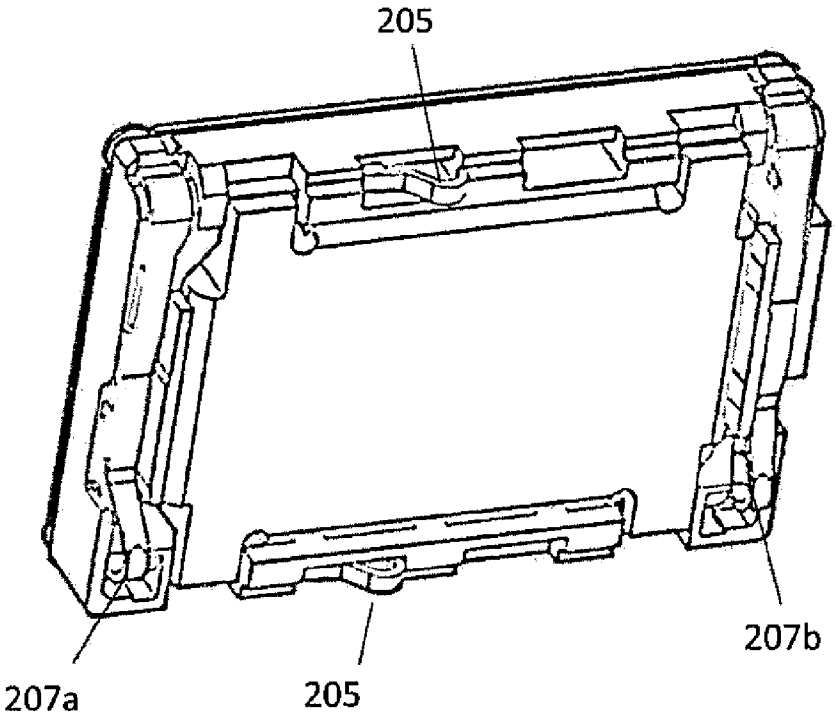
FIG. 4 illustrates a schematic orthogonal projection diagram of the underside of the integrated magnetic shield transducer configuration as shown in FIG. 3.

This can be further shown with respect to FIG. 4 which shows an isometric projection from the underside of the transducer. The underside of the transducer shows that there can be two grounding springs 205 which are internally electrically connected to the integrated metal layer or plate 203. These grounding springs are shown forming a suitable mechanical support for the long sides (length) of the transducer, where the signal springs 207*a* and 207*b* form suitable mechanical support for the short sides (width) of the transducer.

Figure 5:
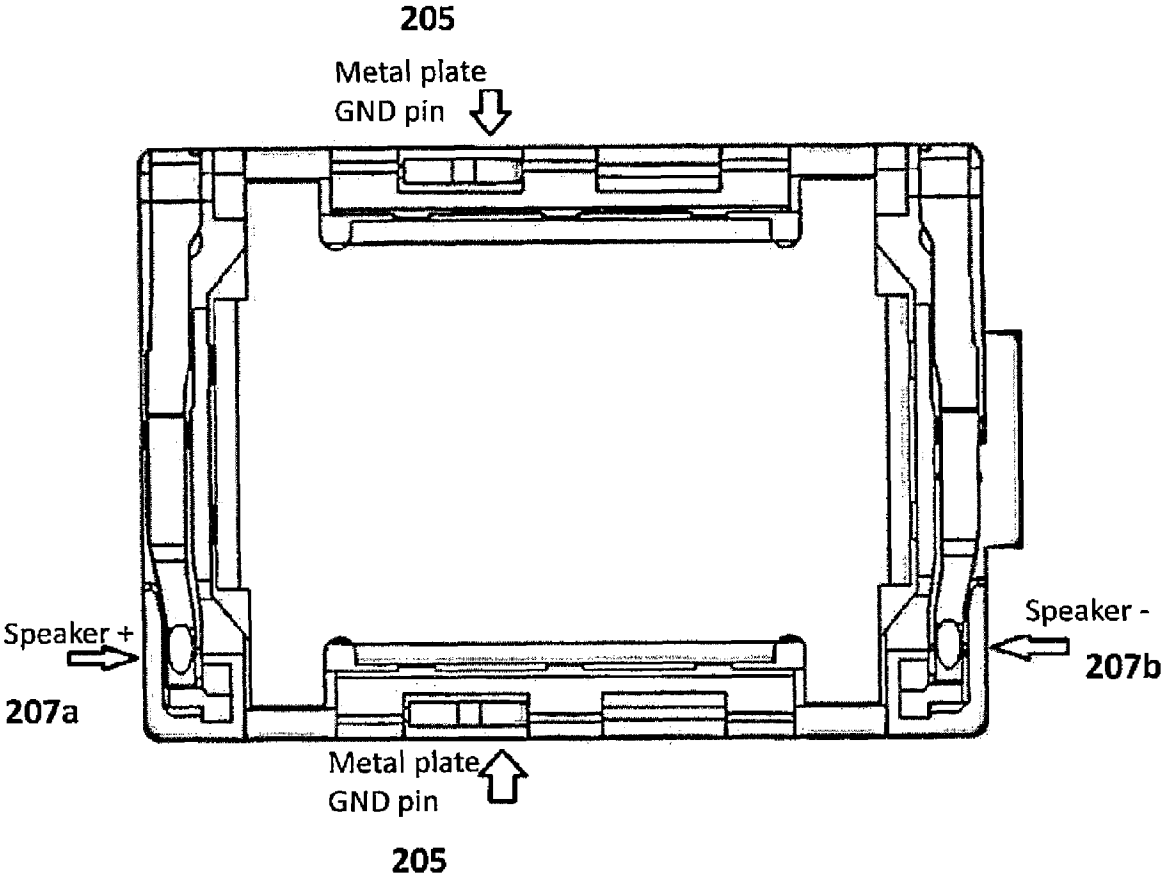
FIG. 5 illustrates a schematic plan projection diagram of the underside of the integrated magnetic shield transducer configuration as shown in FIGS. 3 and 4.

Furthermore with respect to FIG. 5 a plan projection of the underside of the example transducer is shown where the positive terminal signal spring 207*a* and the negative signal spring 207*b* are shown on opposite (short or width) sides of the transducer and the two grounding springs 205 are shown on opposite sides to each other on the long or length sides of the transducer thus forming four suitable points of contact when the transducer is located on the printed wiring board.

In the examples shown herein the signal springs and he grounding springs are shown having a leaf spring configuration. However it would be understood that in some embodiments the profile of the springs can be any suitable shape or form suitable for providing an electrical contact.

Figure 6:
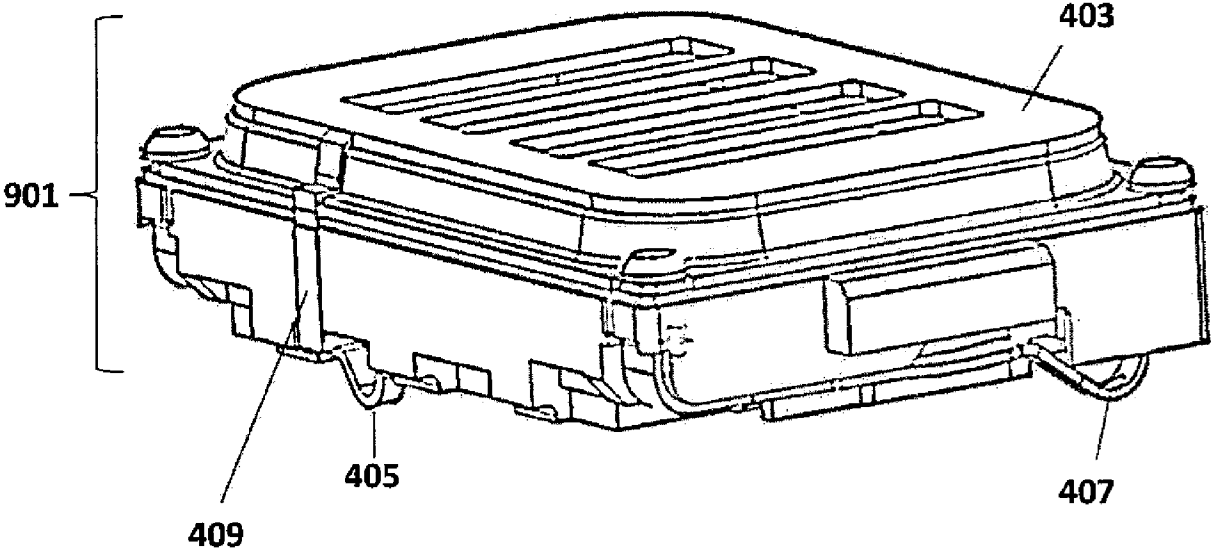
FIG. 6 illustrates a schematic orthogonal projection diagram of a further integrated magnetic shield transducer configuration according to some embodiments of the application.

With respect to FIG. 6 a further example of the integrated transducer 401 is shown comprises an integrated metal layer or plate 403, a grounding spring 405, and a signal spring 407. The example shown in FIG. 6 differs from the examples shown in FIGS. 3 to 5 in that the electrical coupling between the integrated metal layer or plate 403 and the grounding spring 405 is external to the transducer. In the example shown in FIG. 6 the grounding spring 405 is externally electrically coupled to the integrated metal layer or plate 403 by providing a wide bended metal strip 409 between the grounding spring 405 and the integrated metal layer or plate 403. In such a manner the external coupling 409 can be configured to provide good conduction from the integrated metal layer or plate 403 to the grounding spring 405.

Figure 7:
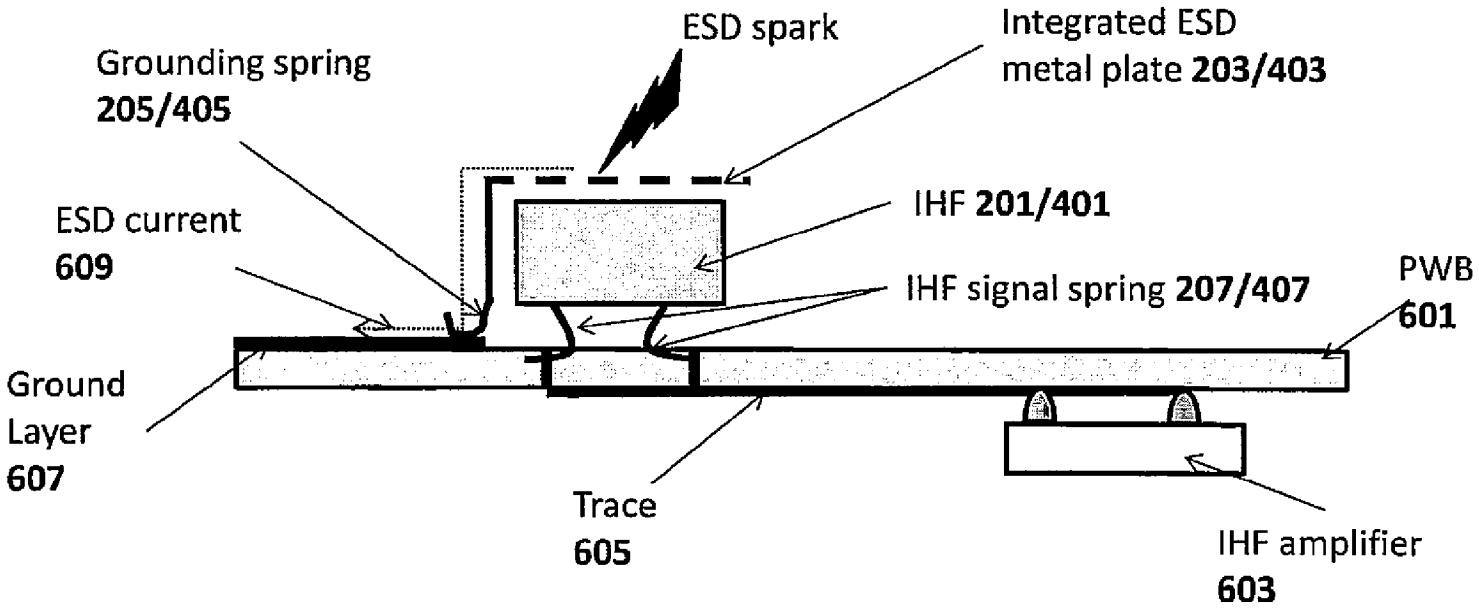
FIG. 7 illustrates the electrostatic protective operation of the integrated magnetic shield transducer configuration according to some embodiments of the application.

With respect to FIG. 7 an example transducer according to some embodiments mounted within a suitable system is shown experiencing an electrostatic discharge. In such embodiments the integrated hands free (IHF) transducer 201/401 or any suitable audio amplifier or audio driver is mounted on a PWB 601 (or suitable support such as a flexible printed circuits "flex" (FPC)) via the transducer signal springs 207/407 and the grounding spring(s) 205/405 (or suitable coupling). The integrated hands free (IHF) transducer 201/401 can be seen with the integrated ESD metal plate 203/403 located above the transducer 201/401 and configured to provide some magnetic shielding to the transducer. Furthermore on the printed wiring board 601 or flexible printed circuits "flex" (FPC) is a trace 605 electrically coupling the transducer (IHF) signal spring 207/407 to a transducer (IHF) amplifier 603. Furthermore on the printed wiring board 601 is a ground layer 607 which is coupled to the grounding spring(s) 205/405.

In the examples as shown with respect to FIG. 7 there are two transducer signal springs and thus two couplings to two contacts with respect to supplying the transducer a signal. However it would be understood that in some embodiments more than two couplings and more than two contacts can be employed. Furthermore in some embodiments at least one of the couplings (such as signal springs) and contacts can be the grounding coupling (or grounding spring) and contact respectively.

In the example shown in FIG. 7 an electrostatic discharge (ESD) spark connecting to the integrated metal plate 203/403 would generate an ESD current 609 shown in FIG. 7 as a dotted line which passes through the grounding spring 205/405 to ground layer 607. In such a manner the transducer (IHF) amplifier 603 and any other ESD sensitive devices can be protected from the ESD and associated harmful current.

In some embodiments there may be a combination of one or more of the previously described embodiments.

It shall be appreciated that the term portable device is user equipment. The user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims. Indeed in there is a further embodiment comprising a combination of one or more of any of the other embodiments previously discussed.

The invention claimed is:

1. An apparatus comprising:

a transducer membrane for generating sound waves; and a plate, through which sound waves can pass, at least partially overlaying the transducer membrane, the plate having at least one plate conduit configured to permit sound waves to pass through the plate;

at least one electrical contact configured to supply a signal to a transducer comprising the transducer membrane to drive the transducer membrane to generate the sound waves; and the plate is conductive and is coupled to at least one grounding contact integrated at component level with the plate such that an electrostatic discharge passes from the plate through the at least one grounding contact without passing through the transducer membrane or the at least one electrical contact, so as to protect the transducer membrane from the electrostatic discharge;

wherein the at least one grounding contact integrated at component level with the plate comprises at least one grounding contact electrically coupled via internal wiring to the plate.

2. The apparatus as claimed in claim 1, further comprising a dust net located proximate to the at least one plate conduit configured to permit sound waves to pass through the dust net.

3. The apparatus as claimed in claim 1, further comprising an apparatus cover comprising at least one apparatus cover conduit configured to permit sound waves to pass through the apparatus cover.

4. The apparatus as claimed in claim 3 wherein the at least one apparatus cover conduit and the at least one plate conduit are skewed with respect to the relative direction to the transducer membrane.

5. The apparatus as claimed in claim 1, further comprising:

a support configured to support the transducer, wherein the transducer is electrically coupled to the support by at least one coupling coupled to the at least one electrical contact, and further supported by at least one ground coupling coupled to the at least one grounding contact such that the electrostatic discharge passes from the plate through the at least one grounding contact and away from the transducer by the at least one ground coupling; and at least one audio driver supported by the support and configured to be coupled via the at least one coupling to the at least one electrical contact.

6. The apparatus as claimed in claim 1, wherein at least one of the at least one electrical contact and the at least one grounding contact is a contact configured to mechanically support the transducer.

7. The apparatus as claimed in claim 6, wherein the at least one electrical contact comprises a first electrical contact defined as a positive terminal coupled to a first end of a transducer coil and a second electrical contact defined as a negative terminal coupled to a second end of the transducer coil.

8. The apparatus as claimed in claim 1, wherein the plate is an integral plate.

9. The apparatus as claimed in claim 1, wherein the at least one grounding contact integrated at component level with the plate is a contact leg configured to ground the plate on a printed wire board or on a flexible printed circuit.

10. The apparatus as claimed in claim 1, wherein the plate comprises a plurality of sound outlet holes through which the generated sound waves can pass.

11. The apparatus as claimed in claim 10, further comprising integrated acoustically transparent covers over the sound outlet holes.

12. The apparatus as claimed in claim 1, wherein the at least one grounding contact provides mechanical stability for the transducer as the transducer rests on a printed wiring board.

13. The apparatus as claimed in claim 1, wherein the at least one grounding contact comprises two grounding contacts electrically connected to the plate and supporting longer sides of the transducer, and wherein the at least one electrical contact comprises two electrical contacts electrically connected to an amplifier and supporting shorter sides of the transducer.

14. The apparatus as claimed in 1, wherein the at least one grounding contact is at least one of a bent metal strip, a transducer signal spring, a grounding spring, a contact spring, and a leaf spring.

15. A method comprising:

providing a transducer membrane for generating sound waves; and locating a plate, through which sound waves can pass, at least partially overlaying the transducer membrane, the plate having at least one plate conduit configured to permit sound waves to pass through the plate;

providing at least one electrical contact configured to supply a signal to a transducer comprising the transducer membrane to drive the transducer membrane to generate the sound waves; and the plate is conductive and is coupled to at least one grounding contact integrated at component level with the plate such that an electrostatic discharge passes from the plate, through the at least one grounding contact without passing through the transducer membrane or the at least one electrical contact, so as to protect the transducer membrane from the electrostatic discharge;

wherein the at least one grounding contact integrated at component level with the plate comprises at least one grounding contact electrically coupled via internal wiring to the plate.

16. The method as claimed in claim 15, further comprising locating a dust net proximate to the at least one plate conduit wherein the dust net is configured to permit sound waves to pass through the dust net.

17. The method as claimed in claim 15, wherein the plate is an integral plate.

18. An apparatus comprising:

at least one processor;

at least one non-transitory memory coupled to the at least one processor; and at least one transducer comprising a transducer membrane for generating sound waves; and a plate, through which sound waves can pass, at least partially overlaying the transducer membrane, the plate having at least one plate conduit configured to permit sound waves to pass through the plate;

at least one electrical contact configured to supply a signal to a transducer comprising the transducer membrane to drive the transducer membrane to generate the sound waves; and the plate is conductive and is coupled to at least one grounding contact integrated at component level with the plate such that an electrostatic discharge passes from the plate through the at least one grounding contact without passing through the transducer membrane or the at least one electrical contact, so as to protect the transducer membrane from the electrostatic discharge;

wherein the at least one grounding contact integrated at component level with the plate comprises at least one grounding contact electrically coupled via internal wiring to the plate.

19. The apparatus as claimed in claim 18, wherein the plate is an integral plate.

* * * * *